United States Patent [19]

Kiesel et al.

[11] 4,302,698

[45] Nov. 24, 1981

[54] DUAL-FILAMENT HALOGEN INCANDESCENT LAMP, PARTICULARLY SEALED-BEAM, AUTOMOTIVE HEADLIGHT

[75] Inventors: Rolf Kiesel, Königsbronn; Manfred Gaugel, Fürstenfeldbruck, both of Fed. Rep. of Germany

[73] Assignee: Patent-Treuhand-Gesellschaft für elektrische Glühlampen m.b.H., Stuttgart, Fed. Rep. of Germany

[21] Appl. No.: 76,421

[22] Filed: Sep. 17, 1979

[30] Foreign Application Priority Data

Sep. 22, 1978 [DE] Fed. Rep. of Germany ..... 2841347

[51] Int. Cl.[3] ..... H01K 00/00

[52] U.S. Cl. ..... 313/222; 313/316

[58] Field of Search ..... 313/222, 115, 316

[56] References Cited

U.S. PATENT DOCUMENTS

| | | | |
|---|---|---|---|
| 3,646,385 | 2/1972 | Wichert | 313/115 |
| 3,646,386 | 2/1972 | Rijnders | 313/115 |
| 3,736,452 | 5/1973 | Rijnders | 313/115 |
| 4,074,167 | 2/1978 | Broek et al. | 313/222 |

FOREIGN PATENT DOCUMENTS

| | | | |
|---|---|---|---|
| 1489101 | 7/1967 | France . | |
| 46-40399 | 4/1968 | Japan | 313/222 |
| 51-9829 | 5/1971 | Japan . | |
| 1229694 | 4/1971 | United Kingdom | 313/222 |

*Primary Examiner*—Robert Segal

*Attorney, Agent, or Firm*—Frishauf, Holtz, Goodman & Woodward

[57] ABSTRACT

The lamp bulb (1) has two filaments (4, 5) positioned within the bulb and parallel to the longitudinal axis (L) thereof, for example located at an axis of symmetry passing through the longitudinal axis, or in two respective planes of symmetry (E4, E5) which are, respectively, parallel to the axis of symmetry (S) of the lamp, the two filaments being preferably symmetrically positioned with respect to the axis of symmetry of the lamp (L). When located in a sealed-beam headlight, one of the filaments forms a depressed beam and the other the high beam, the high beam being preferably positioned along the axis of the reflector, at or close to the focal point thereof, for example by an off-center positioning of the bulb within the reflector.

8 Claims, 6 Drawing Figures

Figures 3A, 3B:
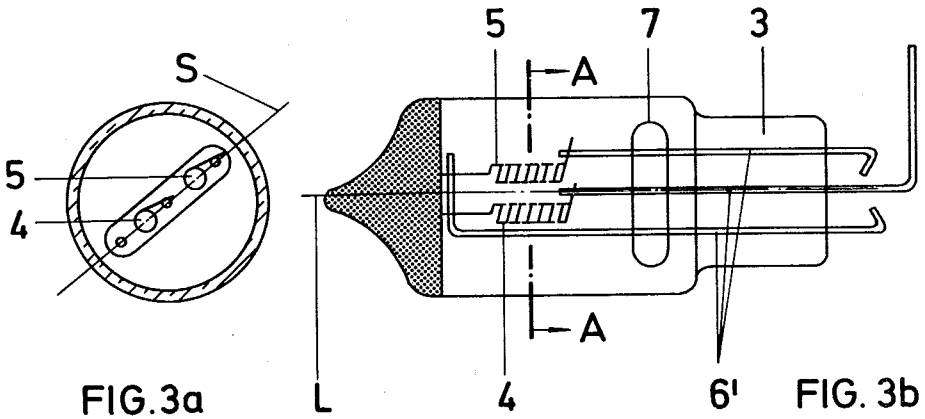

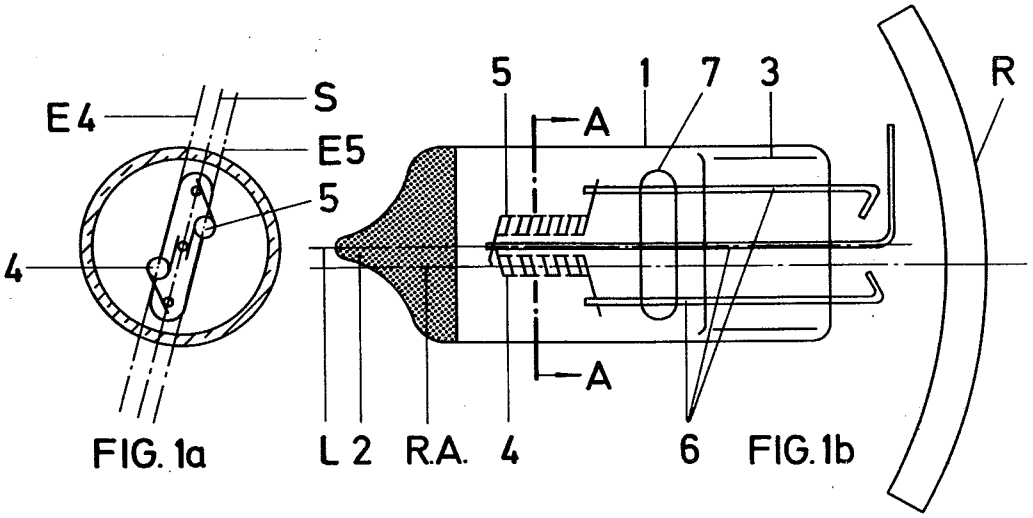
FIG. 1b
FIG. 1a
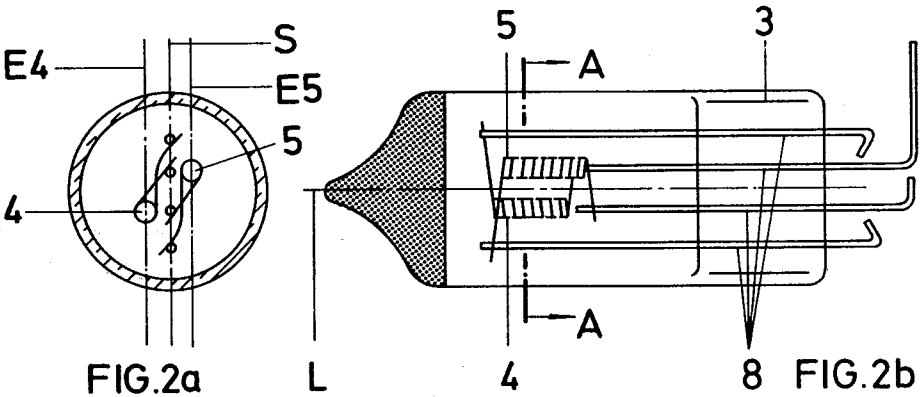
FIG. 2b
FIG. 2a

DUAL-FILAMENT HALOGEN INCANDESCENT LAMP, PARTICULARLY SEALED-BEAM, AUTOMOTIVE HEADLIGHT

The present invention relates to a dual-filament halogen incandescent lamp, particularly for automotive headlights, and especially to sealed-beam headlights, in which the light distribution and the arrangement meet SAE (Society of Automotive Engineers) standards.

BACKGROUND AND PRIOR ART

Sealed-beam headlights placed in glass reflectors and utilizing current supply wires which, simultaneously, hold the incandescent filament, are standard in automotive application. To obtain the asymmetrical low-beam distribution, the respective incandescent filaments therefor are positioned asymmetrically with respect to the longitudinal axis of the headlamp reflector assembly. It is desirable to increase the light output obtainable from sealed-beam headlamps by the use of halogen incadescent lamps. Sealed-beam, headlamps have been proposed in which dual-filament halogen incandescent lamps are used which have two individual filaments positioned along the longitudinal axis of the headlamp, and further including a cover cap in order to obtain the asymmetrical low-beam light distribution which is desired. Such a dual-filament halogen lamp is difficult to construct. Current lamps of this type are being made for European standards. Halogen incandescent lamps use light bulbs of high melting point glass, such as quartz glass, hard glass, or the like. It is desirable to symmetrically place the incandescent filaments within the lamp so that the current supply leads which hold the filaments and which are melted into a press can symmetrically placed in order to prevent stresses in the glass press. Further, the bulb should preferably be loaded essentially uniformly from a thermal point of view.

THE INVENTION

It is an object to construct a simple dual-filament halogen incandescent lamp which is suitable for use in sealed-beam headlights meeting SAE standards for sealed-beam headlights.

Briefly, two filaments are located within a bulb parallel to the longitudinal axis of the lamp and parallel to each other. The two filaments can be placed in a plane of symmetry passing through the longitudinal axis of the lamp, or in planes parallel thereto and, preferably, are positioned symmetrically with respect to the plane. The radiation centers of the two filaments, in the direction of the longitudinal axis of the lamp, may be adjacent, or longitudinally staggered by a distance of at most that of the length of one of the filaments. The current supply leads can be formed as either two individual and one common supply lead, or two individual leads, that is, a total of four leads for the dual-filament lamp. The lamp can be formed with one press at one end, or with two presses, one at either end and located off-center with respect to the reflector axis.

Drawings, illustrating examples, wherein:

FIGS. 1*a* and 1*b* show a dual-filament halogen incandescent lamp in end view along section A—A of FIG. 1*b*, and in side view, respectively, when positioned in a sealed beam reflector (not shown);

FIGS. 2*a* and 2*b* are views similar to FIGS. 1*a*, 1*b*, respectively, and illustrate another embodiment; and FIGS. 3*a*, 3*b* are views similar to FIGS. 1*a*, 1*b* and show yet another embodiment.

The dual-filament halogen incandescent lamp of FIGS. 1*a* and 1*b* has a tubular bulb 1 which, in customary form, has a tip-off, or end nipple 2 which closes off the bulb. The other side of the lamp is formed with a lead-through press 3. Parallel to the longitudinal axis L of the bulb are two longitudinally spiralled filaments 4, 5, in which the filament 4 is used, for example, for depressed or low-beam and filament 5 for high-beam application. The filaments 4, 5 are located in planes E4 and E5 (FIG. 1*a*) which are parallel to a plane of symmetry S. The filaments are spaced from each other by a distance greater than the diameter of the spiral thereof. (see FIGS. 1*a*, 2*a*, 3*a*). The filaments 4, 5 are supplied with electrical currents by supply wires 6 are retained with respect to each other in insulated relationship by a bridge 7 of quartz glass, and which are passed through the press 3 by being melted therein, symmetrical to the longitudinal axis L.

FIGS. 2*a*, 2*b* show a lamp which, in general, is of somewhat similar construction; the filaments 4, 5 are positioned in planes E4, E5 parallel to the axis of symmetry S, but supplied by individual supply wires 8, positioned symmetrically with respect to the longitudinal axis L and located and melted in into the press 3.

FIGS. 3*a*, 3*b* show a dual-filament halogen incandescent lamp in which the filaments 4, 5 are positioned within the plane of symmetry S and parallel to the longitudinal axis L. Three current supply wires 6', insulated by a quartz bridge 7 with respect to each other and holding the wires in position, provide additional support for the wires 6' which are lead through the press 3. The lowermost one of the connection wires 6' is a common connection which is bent over at the end closest to the end cap portion of the lamp. In order to suppress direct radiation from the lamp, the bulb is blackened at the end with a black coating.

The depressed beam and high beam, respectively, has different light distribution. To obtain the appropriate light distribution in accordance with SAE standards and requirements, the dual-filament lamp of any one of the embodiments is so located within a sealed-beam reflector that the filament 4, to generate the high beam, is located in, or at least as close as possible to the focal point of the reflector, the axis of which is indicated at R.A. (reflector axis) in FIG. 1. A similar showing in the other figures has been omitted for clarity. This positioning then places the filament 5 for the depressed beam outside of the reflector axis, and somewhat away from the focal point in order to obtain the light distribution required by the SAE standard. Such positioning can be obtained by placing the lamp in the reflector in a slightly off-center or rotated position, so that the lamp filament for the depressed light will be, as known, above and slightly laterally with respect to the axis of the 4 which generates the high-beam light.

The reflector itself is shown only schemtically and in fragmentary form at R in FIG. 1. A similar showing in the other figures has been omitted for clarity. The connection of the lamp press 3 to the reflector, and the external socket connections of the leads 6. 6', 8, respectively, can be in accordance with any well known and standard construction. If the two filaments have identical power rating, manufacture of the lamp is simplified since it is then possible to so arrange the placement of the bulb 1 in the reflector R that two positions of the bulb are allowed.

The lamp in accordance with the present invention has the advantage that a complete sealed beam halogen cycle automotive headlight is provided, having the improved light output and efficiency of the halogen cycle lamp while still meeting SAE requirements and being simple to manufacture. Alternatively, the reflector and lamp can be separate so that the lamp is replaceable, and so matched to each other that the light distribution meets SAE standards.

The lamp in accordance with the invention can be used in combination with a reflector, as a socket-less lamp with a hermetically sealed reflector. It may also be used as lamp with socket for separate association with a reflector for headlamps in which the lamp can be replaced by a new one, without difficulty, while reusing the reflector, The lamp reflector association can be so arranged that the reflector axis coincides with the axis of one of the filaments typically the high beam filament 4, that is 0°/0° tilt, or, respectively, such that the reflector axis is tilted with respect to the filament axis. If the tilt position is so selected, the light beam which is emitted is deflect towards the right and downwardly, for example 3°R/3°D, in which R means right, and D means down. The extent of the tilt determines the position of the light emitting element with respect to the reflector axis and the reflector focal point. At 0°/0° tilt, the high beam light emitting element is in the focal point. At 3°R/3°D tilt, the depressed beam light emitting element is in the focal point. An intermediate position is also possible, in which no light emitting element is directly at the focal point. FIG. 1*b* shows one of possible examples of positioning.

The light emitting elements are spaced from each other in a direction, which is transverse to the longitudinal axis of the lamp. The light emitting elements need not be at the longitudinal same level. While maintaining the transverse distance, they can additionally be offset longitudinally with respect to each other, that is the light emitting elements can be somewhat shifted longitudinally along the axis of the lamp (FIGS. 26). The distance between the main light emission centers of one light emitting element to that of the other light emitting element taken in the longitudinally direction of the lamp, should not be more than the length of a light emitting element.

The main light emission center of a light emitting element is the theoretical center of the light emitting element.

When mounting the lamp bulb into the reflector, the lamp bulb as a whole is positioned in the appropriate space of the reflector with a standard closing lens at its front. An additional holding bail for the lamp (not shown) may also be secured to the lamp-reflector structure.

Various change and modifications may be made, and features described in connection with any one of the embodiments may be used with any of the others, within the scope of the inventive concept.

We claim:

1. Automotive head lamp dual-filament halogen incandescent lamp in combination with a reflector structure (R) having a reflector axis (R.A.) comprising a lamp bulb (1) having a longitudinal lamp axis (L);

two longitudinally spiral filament (4,5) positioned within the lamp bulb (1) parallel to the longitudinal axis (L) of the bulb;

at least three current supply wires (6, 6', 8) positioned in a lamp bulb and respectively connected to the respective filaments to permit, selectively, individually energization of the two filaments;

a bridge (7) extending across the lamp bulb, at least two of the current supply wires passing through the bridge;

wherein transverse the two filaments (4,5) are in mutual essential/alignment with respect to the longitudinal extent of the filament;

one filament (4) is located laterally to one side of the longitudinal axis (L) of the bulb and the other filament (5) is located laterally to the other side of the longitudinal axis (L) of the bulb, and is in a plane passing through said one filament and the axis (L) of the bulb;

said filaments (4,5) are located in planes which are parallel to the plane of symmetry (S) of the lamp; and the longitudinal axis (L) of the lamp bulb is parallel to and offset from the reflector axis (R.A.).

2. Lamp according to claim 1, wherein the two filaments (4, 5) are located within a plane of symmetry (S) which passes through the longitudinal axis (L) of the bulb.

3. Lamp according to claim 1, wherein the two filaments (4, 5) are located in respectively differently planes (E4, E5) which are parallel to the plane of symmetry (S) of the lamp.

4. Lamp according to claim 1, wherein the two filaments (4, 5) are positioned symmetrically with respect to the longitudinal axis (L) of the lamp.

5. Lamp according to claim 1, wherein (FIGS. 1, 3) three current supply wires (6, 6') are provided, passing through an end press (3).

6. Lamp according to claim 1, wherein (FIG. 2) four current supply wires (8) are provided, two each supporting and being connected to respective filaments (4, 5).

7. Lamp according to claim 1, wherein the lamp has a single-ended press (3).

8. Lamp according to claim 1 wherein the lamp bulb (1) and the reflector structure (R) are sealed together to form a sealed beam automotive headlight.

* * * * *